US005603615A

United States Patent [19]

Liaw

[11] Patent Number: 5,603,615

[45] Date of Patent: Feb. 18, 1997

[54] SMOKE POLLUTION DEVICE FOR TUNNEL KILN

[76] Inventor: Wei-Wau Liaw, No. 22-16, Yung Chun Road, Nan Tun Dist., Taichung, Taiwan

[21] Appl. No.: 371,967

[22] Filed: Jan. 12, 1995

[51] Int. Cl.[6] ..... F27B 9/02

[52] U.S. Cl. ..... 432/128; 432/120; 432/133; 432/136; 432/143; 432/145; 432/103; 432/117

[58] Field of Search ..... 432/120, 128, 432/133, 136, 143, 145, 103, 117

*Primary Examiner*—Henry A. Bennett
*Assistant Examiner*—Siddharth Ohri
*Attorney, Agent, or Firm*—Bacon & Thomas

[57] ABSTRACT

The present invention relates to a smoke and heat source recycling device for a tunnel kiln in order to prevent smoke pollution. It has an exhaust fan in the preheating zone, the exhaust fan absorbing heat from the preheating zone and delivering such heat to a heat energy adjustment zone and waste gas treatment system for treating pollutants such as coal dust. Heat in the dry zone is delivered into the exhaust duct through an exhaust collector. A and pollution controller detects the pollution and enters signal into an electronic control to control gates for exhaust gas to enter either a gas treatment system or to be emitted into the air through the chimney.

1 Claim, 4 Drawing Sheets

SMOKE POLLUTION DEVICE FOR TUNNEL KILN

BACKGROUND OF THE INVENTION

The present invention relates to a smoke pollution device for a tunnel kiln, for improving smoke emissions of a brick kiln, for heat recycling, for the reduction of production costs, for protecting air quality and for preventing pollution to the ecological environment.

Air pollution and ecological imbalance caused by the emissions of brick kilns have been major concerns in the public. Further, the waste of production cost has resulted from failure of recycling the heat energy discharged with the smoke. Referring to FIG. 1, the conventional tunnel kiln comprises a dry kiln 1, a main kiln 2, the main kiln 2 being about 120 to 150M long, and the dry kiln 1 about 100 to 120M long. The dry kiln 1 is mainly for preheating brick blanks made from clay mixed with water and additive. Such blanks are sent into the main kiln 2 for heating to become finished bricks. A heat source in the main kiln 2 comes from the combustion of coal powder, and smoke produced from the combustion will be drafted by means of the pump 201 outside the main kiln 2 for emission through the chimney 202. Because the smoke contains sulphurides and coal ashes not completely burned, it often causes the death of plants near the brick kiln, moreover it severely affects nearby air quality and is hazardous to human health, and is not consistent with modern environmental requirements. As a large amount of heat energy is discharged with smoke emission, it not only increases the burden to air quality but also increases production cost due to heat loss.

Referring to FIG. 2, an improvement is made wherein smoke is drafted by the pump 25 from preheating zone 21 and combustion zone 22 into the complete combustion zone 23 through the flue 24. When the smoke containing sulphurides and steam is released from the complete combustion zone 23, steam and sulphurides will be absorbed by the bricks (because the temperature of the completed bricks is higher than that of hot smoke). Another pump 232 is provided for drafting hot air from the complete combustion zone 23 into the dry kiln 1 for preheating the wet blanks. Most of the smoke containing residual powder will be drafted into the combustion zone 22 through the flue 24 for secondary combustion.

However, the improvements of the aforesaid are not consistent with logic and the laws of thermodynamics:

1. According to the laws of thermodynamics, high temperature flows to low temperature to reach a thermobalance. According to the aforesaid description "for the temperature of completed bricks is higher than that of hot smoke", sulphurides and steam of the smoke will be absorbed by the bricks, which is against the laws of thermodynamics. The discharge of some steam, sulphurides and coal ashes from the completed combustion zone 23 and the discharge of some from the pump 232 into the dry kiln 1 not only will cause blackening and yellowing (due to sulphurides) of wet blanks and completed bricks, but also sulphurides, coal ashes and smoke will be discharged from the dry kiln 1 to cause air pollution, and damage to human body, and nearby vegetation.
2. Residual particles of the smoke cannot be drafted to the combustion zone 22 for secondary combustion through the flue 24. Some of the smoke in the flue 24 that is discharged into the complete combustion zone 23, will be emitted from the outlet and some will be drafted by the pump 232 into the dry kiln 1.

These and other objects and advantages of the present invention will become apparent to those skilled in art after considering the following detailed specification together with the accompanying drawings.

DETAILED DESCRIPTION OF PREFERRED EMBODIMENT

Figure 1:
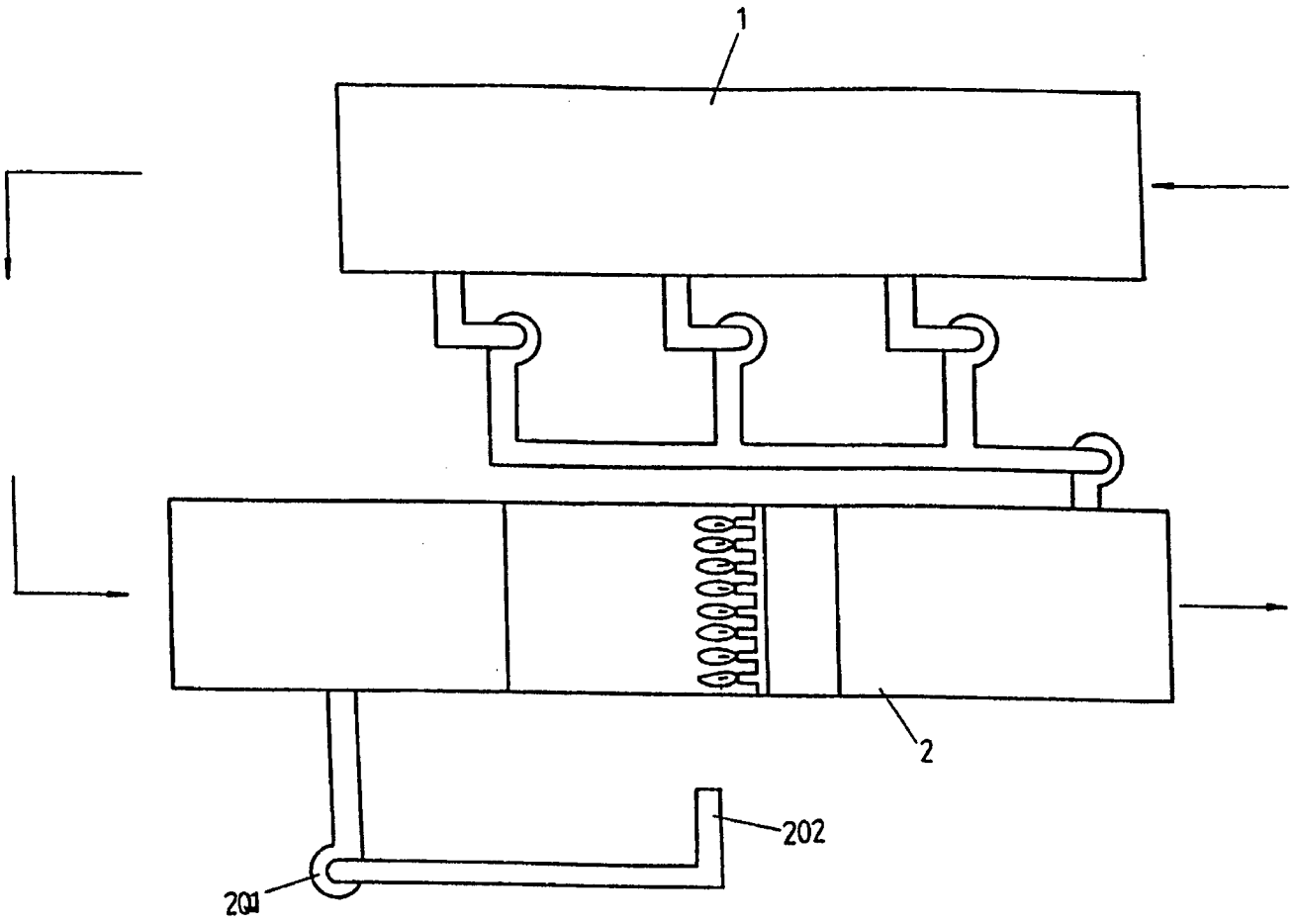
FIG.1 PRIOR ART
FIGS. 1 and 2 are schematic views of the conventional tunnel kilns.
Figure 2:
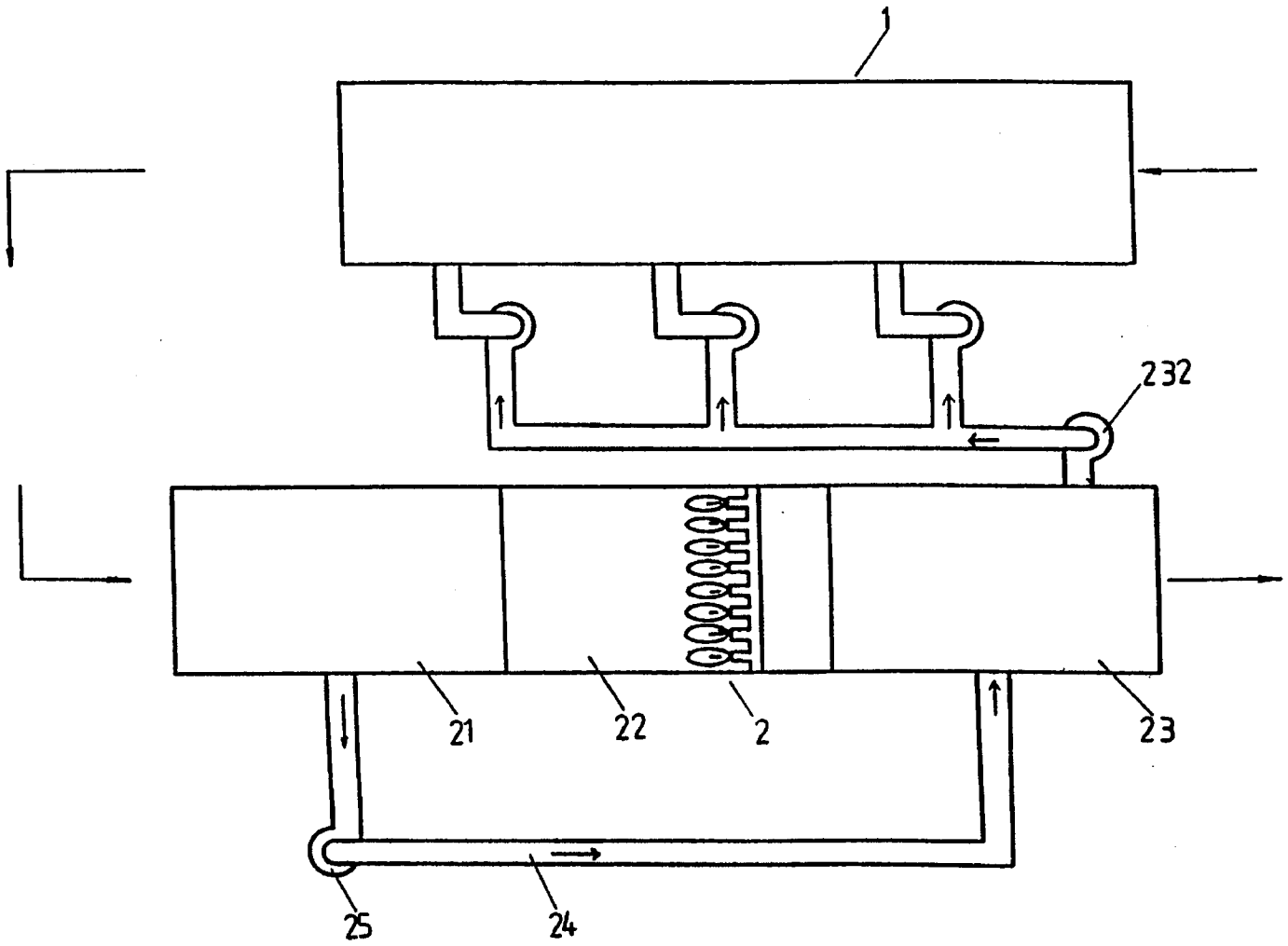
FIG.2 PRIOR ART
Figure 3:
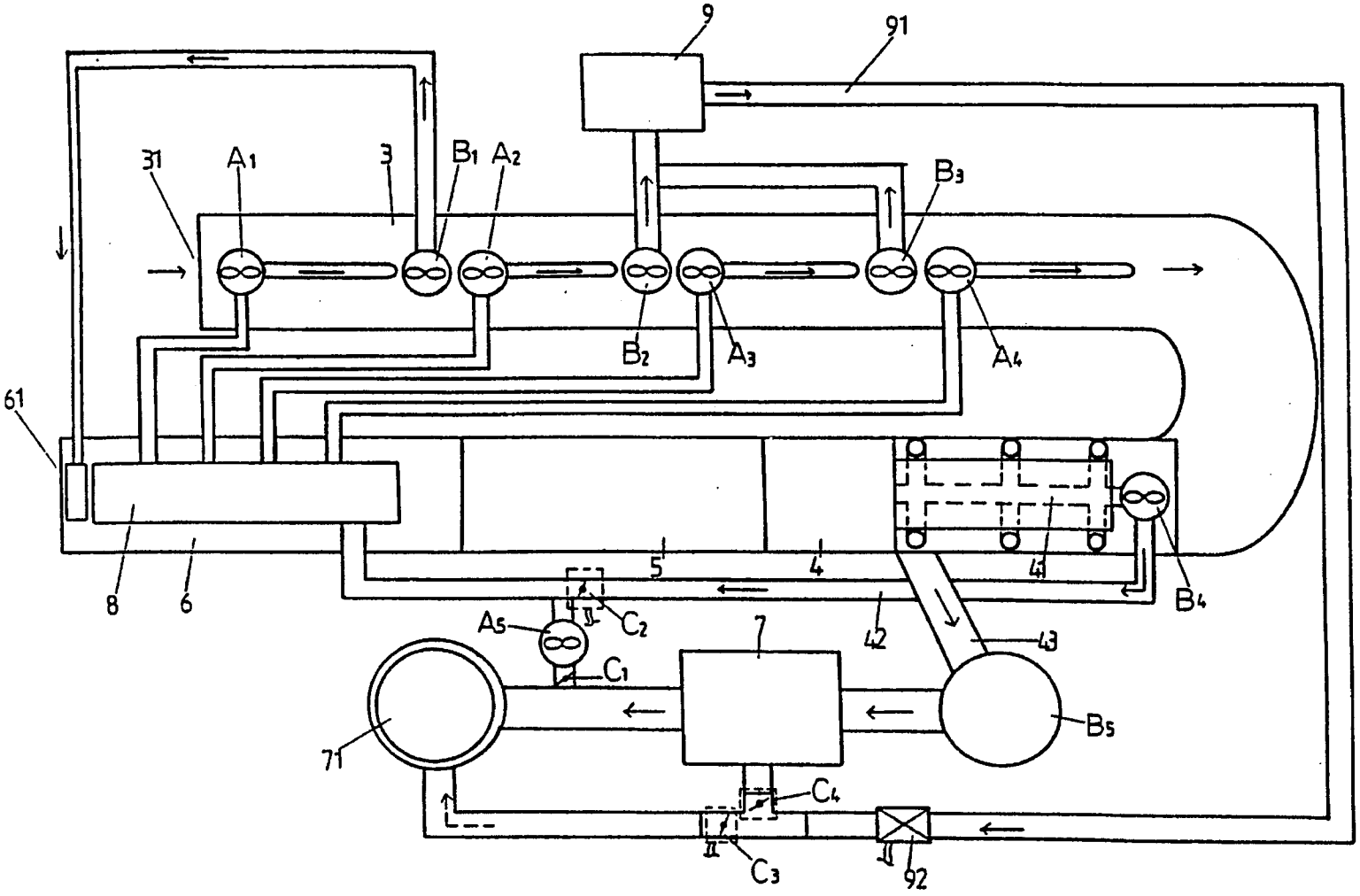
FIG. 3 is a diagrammatic view of the present invention.

Referring to FIG. 3, the present tunnel kiln comprises dry zone 3, preheating zone 4, sintering zone 5 cooling zone 6 and waste gas treatment system 7.

Dry zone 3 is a preheating place for the formation of wet blanks, communicating with air blowers A1, A2, A3 and A4 for the input of heat in heat energy adjusting zone 8. Said dry zone 3 has a plurality of exhaust fans B2, B3 for drafting gases from dry zone 3 and gathering them in exhaust collector 9. Exhaust fan E1 will discharge gases into cooling zone 6.

Preheating zone 4 is provided for heating brick blanks, and there are a plurality of air ducts 41 therein. Heat absorbed from preheating zone 4 by means of exhaust fan B4 will be delivered to heat energy adjusting zone 8 through the air duct 42, Said preheating zone 4 is connected with another air duct 43 for delivering the smoke containing coal ashes not completely burned from preheating zone 4 into gas treatment system 7 by means of exhaust fan B5. One end of said gas treatment system 7 is connected with a chimney 71, and the other end connected to air blower A5. The inlet of said air blower A5 has a gate C1, and the outlet of said air blower A5 is connected to air duct 42 leading to heat energy adjusting zone 8. The front end of the joint has a gate C2, said gates C1 and C2 jointly connected to electrical controller 10.

Figure 4:
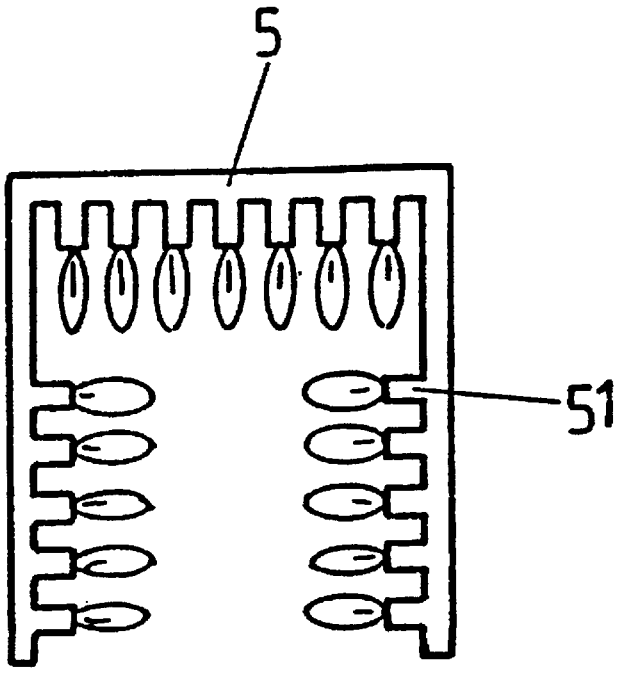
FIG. 4 is a diagram showing the torch in the sintering zone according to the present invention.

Sintering zone 5 accommodates a number of torches 51 distributed in a manner illustrated in FIG. 4, using coal ashes as material of combustion, to enable sintering zone 5 to produce 950° C. heat.

Cooling zone 6 is the terminal of the brick kiln, a cooling area for bricks, and the temperature is lower close to the outlet 61.

On the outlet of gas collector 9 connected to exhaust fans B2 and B3 in dry zone 3 is an air duct 91, the other end of said air duct 91 is connected to chimney 71 and has a gate C3. Said air duct 91 in front of gate C3 is leading to gas treatment system 7, having a gate C4, two valves C3 and C4 connected to electrical controller 10, and in proper position of said air duct 91 has an anti-pollution switch 92, said switch 92 also connected to electrical controller 10.

950° C. heat produced from sintering zone 5 will be spread to preheating zone 4, exhaust fan B4 will deliver heat into heat energy adjusting zone 8 (gate C2 open). Air blowers A1, A2, A3, A4 in dry zone 3 will deliver heat from heat energy adjusting zone 8 into dry zone 3 of the brick kiln for preheating wet blanks and partially removing moisture from the blanks for setting the form of blanks. Blank bricks upon setting will be heated in preheating zone 4 and be dried by evaporation. Smoke produced from the combustion of coal ashes in sintering zone 5, and smoke containing coal powder will be discharged into preheating zone 4 by means of convection with two exhaust fans B4, B5. Heat in preheating zone 4 will be drafted by exhaust fan B4, and air duct 43 is located near sintering zone 5 so most of the smoke, coal powder and steam produced from combustion will be delivered into gas treatment system 7 by means of exhaust fan B5 through air duct 43. For removing coal powder and recycling, smoke removed and steam will be discharged. Electrical controller 10 will cause gate C1 to open, air blower A5 will start delivering heat into heat energy adjusting zone 8. Waste gases carrying steam and smoke gathered in dry zone 3 by means of gas collector 9 will be delivered into gas treatment system 7 through air duct 91 for filtering (gate C3 closed while gate C4 open).

Air duct 91 has an anti-pollution controller 92 that may detect the pollution of heat in air duct 91. If pollution is high, a signal will be transmitted to electrical controller 10 to close the gate C3 and to open gate C4 for delivering heat into gas treatment system 7. If heat in air duct 91 meets statutory values for environment protection and is cooling down near ambient temperature without recycling, electrical controller 10 will receive a signal from anti-pollution controller 92 to open the gate C3 and close the gate C4 so that waste gases will be discharged to the air by virtue of chimney. For heat to be discharged into the gas treatment system 7 by virtue of exhaust fan B5, electrical controller 10 will cause the gate C2 to close while another gate C1 to open so that heat will be discharged to the air by virtue of chimney 71.

Gradual preheating of brick blanks in preheating zone 4 can prevent them from cracking due to instant heating while giving enough time for restructuring of crystals in the bricks so as to adapt to 950° C. temperature in sintering zone 5. Upon completion of sintering by torches 51, the bricks will be slowly cooled through cooling zone 6 and be delivered to the outlet 61 of the brick kiln.

Referring to FIG. 3, exhaust fan B1 of dry zone 3 will deliver air to the outlet 61 of cooling zone 6 for reversed discharge of gas into cooling zone 6 for increasing the cooling speed of the bricks in the cooling zone and for stirring up coal powder incompletely burned on brick conveyor so that coal powder will be absorbed by heat energy adjusting zone 8 and be discharged into the kiln for recycling.

The present invention according to the aforesaid description has the following advantages:

1. Recycling of heat for preheating wet blanks.
2. Smoke, coal ashes and steam produced from combustion can be filtered through a gas treatment system to meet the requirements of environmental protection for heat recycling. When the heat source is cooling down to ambient temperature, it will be discharged to the air by virtue of chimney so as to energy.
3. Heat source may meet the requirement of environmental protection after being treated through a gas treatment system so as to reduce environmental pollution due to emission to the air.
4. After being collected by the gas treatment system, coal ashes can be provided for secondary combustion to reduce environmental pollution and for energy conservation.

I claim:

1. A smoke pollution device for a tunnel kiln, comprising: dry zone, preheating zone, sintering zone, cooling zone, heat energy adjusting zone and gas treatment system wherein: the dry zone for preheating and setting brick blanks, has a plurality of air blowers for sending heat to the heat energy adjusting zone, said dry zone having a plurality of exhaust fans for drafting gases from the dry zone into a gas collector;

the preheating zone for slow heating and setting brick blanks, has a plurality of air ducts, heat absorbed from the preheating zone is delivered, by means of exhaust fans and airducts to the heat energy adjusting zone, said preheating zone also having an exhaust fan for delivering smoke containing incompletely burned coal ashes to the gas treatment system by means of exhaust fans, one end of said gas treatment system connected to a chimney, the other end connected to an air blower, the inlet of said air blower having a gate, and an outlet of said air blower connected to an air duct leading to the heat energy adjusting zone, the front end of joint having a gate;

the sintering zone having torches using coal ashes as fuel to produce 950° C. heat in the sintering zone;

the cooling zone located at a terminal end of the brick kiln for cooling the bricks, wherein the temperature decreases close to an outlet of the cooling zone;

a gas collector connected to each exhaust fan in the dry zone, an outlet connected to an air duct, another end of air duct connected to a chimney and having a gate, an air duct in front of the gate leading to the gas treatment system having a gate, the two gates connected to an electrical controller, said air duct having an anti-pollution switch also connected to the electrical controller;

whereby coal ashes and smoke collected in the gas collector enter the gas treatment system for filtering or to be discharged to the air through the control of the gates subject to a signal to the electrical controller from the anti-pollution switch, and gases enter into the gas treatment system for recycling in the heat energy adjusting zone or emission to the chimney subject to the control of the air blower and gate by the electrical controller; and gases enter the outlet of the cooling zone by means of exhaust fans in the dry zone for increasing the cooling speed of the bricks from the sintering zone, and stirring up incompletely burned coal powder accumulated on a brick conveyor for absorbing by the heat energy adjusting zone and for delivering to the kiln for recycling.

* * * * *